US009695012B2

(12) United States Patent
De Jong et al.

(10) Patent No.: US 9,695,012 B2
(45) Date of Patent: Jul. 4, 2017

(54) ELEVATOR WITH COMPENSATION ROPE

(71) Applicant: KONE CORPORATION, Helsinki (FI)

(72) Inventors: Johannes De Jong, Järvenpää (FI); Jussi Perälä, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 208 days.

(21) Appl. No.: 14/098,284

(22) Filed: Dec. 5, 2013

(65) Prior Publication Data

US 2014/0166406 A1 Jun. 19, 2014

(30) Foreign Application Priority Data

Dec. 6, 2012 (EP) ..... 12195928

(51) Int. Cl.
*B66B 7/10* (2006.01)
*B66B 7/06* (2006.01)

(52) U.S. Cl.
CPC ..... *B66B 7/10* (2013.01); *B66B 7/068* (2013.01)

(58) Field of Classification Search
CPC ..... B66B 7/068; B66B 7/10; B66B 11/0065; B66B 11/009; B66B 15/02; B66B 15/04; B66B 15/06
See application file for complete search history.

(56) References Cited

U.S. PATENT DOCUMENTS 483,203 A * 9/1892 Bassett ..... B66B 11/009 187/254
485,163 A * 11/1892 Bassett ..... B66B 11/009 187/260
2010/0163347 A1* 7/2010 Van Der Meijden ... B66B 19/00 187/254
2014/0231179 A1* 8/2014 Alasentie ..... B66B 11/0045 187/251

FOREIGN PATENT DOCUMENTS

DE 102006037253 A1 * 2/2008 ..... B66B 11/009
JP 60-145169 U 9/1985
KR 10-0821640 B1 4/2008
NL 4777 2/1920

OTHER PUBLICATIONS

English Machine Translation of JP 60-145169 U.*

* cited by examiner

*Primary Examiner* — Michael Mansen
*Assistant Examiner* — Diem Tran
(74) *Attorney, Agent, or Firm* — Birch, Stewart, Kolasch & Birch, LLP

(57) ABSTRACT

An elevator includes at least one elevator car and a counterweight which are at least partly suspended on hoisting ropes and a drive machine driving a traction sheave engaging the hoisting ropes for moving the elevator car along guide rails in an elevator shaft, which elevator further includes a compensation rope. The compensation rope is led upwards to an upper part of the elevator shaft and from there aside to a balancing area located aside of the travel paths of the car and counterweight. This solution is particularly adapted for high travel elevators facing horizontal forces during operation as e.g. ship elevators. Collision of compensation ropes are avoided in the area below the car and counterweight paths which could affect the elevator safety (Continued)

Figure 1:
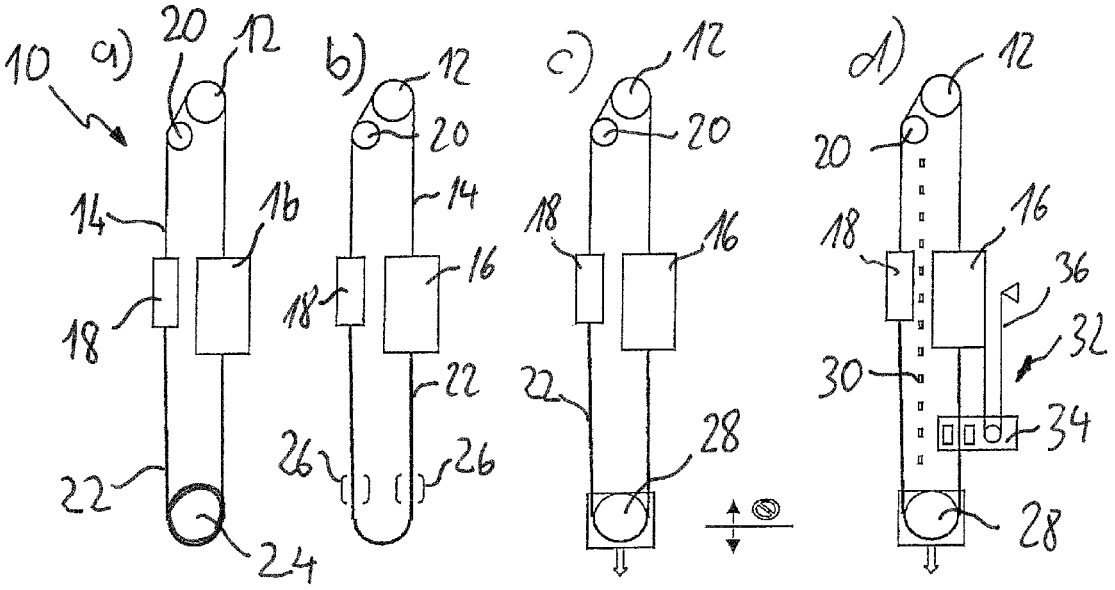
Fig. 1 (prior art)

when subjected to high horizontal forces, e.g. during rough sea.

19 Claims, 3 Drawing Sheets a)
b)
c)
d)
51
48
12
50
46
20
16
18
42
40
54
52
22
44
56
58
60
62
28
66
64

51
40
48
50
12
46
20
16
18
42
52
44
22

ELEVATOR WITH COMPENSATION ROPE

The present invention relates to an elevator with a compensation rope. The invention particularly relates to elevators which are configured to be used in ships. In large ships elevators have elevator shafts with a height of 50 meters or more. In these high elevator shafts usually traction sheave elevators are used having at least one elevator car and a counterweight which are at least partly suspended on hoisting ropes. The hoisting rope is running over a traction sheave so that the traction sheave moves the car and the counterweight between their extreme upper and lower positions. In the above mentioned large elevator shafts usually compensation ropes are used to eliminate the load portion which is caused by the imbalance of the hoisting rope weight particularly in the extreme positions of the car and counterweight. Accordingly, the weight of elevator ropes in a high elevator shaft may sum up to hundreds of kilograms. The compensation rope is usually connected to the car and counterweight and extends in the lower part of the shaft so that the hoisting ropes form together with the compensation rope a closed loop so that any vague imbalances because of the ropes are avoided or minimized.

FIGS. 1*a-d* show four concepts for realizing such types of elevators. The elevator in FIG. 1*a* comprises and shows a typical traction sheave elevator 10 having a drive machine (not shown) a traction sheave 12, driving hoisting ropes 14 on which a car 16 and a counterweight 18 are suspended. A diverting pulley 20 is provided in the upper part of the shaft so that the distance between the rope parts connected with the car and counterweight have a desired mutual distance. The bottom of the car 16 and counterweight 18 are connected with a compensation rope 22 hanging down near to the bottom of the elevator shaft so that the hosting ropes together with the compensation ropes 22 form a closed loop.

Regularly, the lower sling formed by the compensation rope 22 is guided by a lower diverting pulley 24, although such a lower diverting pulley is not absolutely necessary. In moved systems as e. g. ships, horizontal forces may act on the elevator components which is not problematic as the car and counterweight run along guide rails and are therefore fixed in a defined position with respect to the horizontal plane. A problem in this system are the compensation ropes which hang loose in an elevator shaft of e.g. 50 meter length. For these reasons concepts can be used as shown in FIG. 1*b* wherein the same or functional identical elements to FIG. 1*a* are provided with the same reference numerals. In this solution guide means 26 are provided in the lower part of the shaft which keep the compensation rope 22 in a defined mutual distance. These guide means could be provided in a height under the lower most position of the car or counterweight.

A further concept is disclosed in FIG. 1*c* showing a lower tensioning means 28 comprising a diverting pulley which is biased either via gravity or via a spring loaded means to the bottom of the shaft. This tension means keeps the compensation rope 22 under tension and therefore reduces the danger that the compensation ropes below the car and counterweight may come into contact with each other during an increased sway of a ship in rough sea.

The best protection against horizontal forces acting on an elevator system is shown in FIG. 1*d*. This known elevator comprises additionally to the tension means 28 in the bottom of the shaft a separation element 30 between the car and counterweight so that the compensation rope parts below the car and counterweight cannot come into contact with each other. Additionally or alternatively to the separation element

30 a follower guide element 32 can be used comprising of a guide 34 which is suspended on a suspension rope 36 mounted between the elevator car and the shaft wall. The higher the car climbs in the shaft the larger the distance between the car and the guide element 34 becomes. The lower the elevator car drives in the elevator shaft the smaller the distance between the car 16 and the guide element becomes. This has the advantage that in the lower most position the guide element 34 is automatically arranged directly below the elevator car so that the suspended guide arrangement 32 does not take any essential additional vertical height. On the other hand if the car travels to the upper shaft portion the distance of the follower guide element to the car becomes larger which provides a better guide function. The suspended guide means 32 is also called "follower carriage". Especially in ships the above mentioned traditional compensation of ropes by compensation ropes or chains and tensioning devices is avoided because the sway of the compensation ropes is difficult to handle. The sway can be more than 10 degrees in normal use. The travel heights in big ships can be close to 60 meters.

Accordingly, even with the quite complicated and expensive systems shown above the problems of compensation ropes or compensations chains are difficult to handle in ships.

It is therefore object of the present invention to provide an elevator which is insensible against horizontal forces acting on the elevator system or position movements of the complete elevator system.

The object of the invention is solved with an elevator according to claim 1. Preferred embodiments of the invention are subject matter of the dependent claims.

According to the invention the elevator comprises at least one elevator car and a counterweight which are at least partly suspended on hoisting ropes. A drive machine is provided driving a traction sheave engaging the hoisting ropes for moving the elevator car along guide rails in an elevator shaft. The elevator further comprises a compensation rope or balancing chain fixed between the car and the counterweight.

According to the invention the compensation rope is led upwards to an upper part of the elevator shaft and from there aside to a balancing area located aside of the travel paths of the car and counterweight.

A collision of portions of the compensation rope running in opposite directions or a collision of the compensation rope with the car or counterweight or other structures in the shaft can thereby effectively avoided.

This has the advantage that the compensation rope is transferred to a part of the elevator shaft or to a separate shaft—the balancing area—where they are separated from the travel paths of the car and counterweight. In this balancing area the compensation ropes can be guided along their complete vertical extension as the vertical run of the compensation rope in the balancing area is not disturbed by the car or counterweight. The run of the compensation rope in the balancing area can therefore much more easily be protected against sway or horizontal forces. Furthermore, the balancing area may be a part of the elevator shaft which is separated, e. g. by a thin separating wall from the travel path of the current counterweight. Accordingly, the safety of this elevator concept also against very intensive sway is much better than in the traditional solutions. The balancing area could even be shifted to a separate shaft running aside of the elevator shaft or somewhere else. In this separated balancing area the guide of a tensioning of the compensation rope can be performed without having to consider the restrictions present in a traditional elevator shaft where the travel path of the car and counterweight build obstructions for technical guiding solutions for the compensation rope. As in the separated balancing area there is no harm of the compensation rope particularly the balancing part thereof coming into contact with the moving car or counterweight any guide of the compensation rope can even be left away so that the compensation rope may hang freely only tensioned by its own weight in the balancing area.

The compensation rope may either be connected to the car and counterweight or only to one of these components. In this latter case one part of the compensation rope has to be led first to the lower part of the shaft around a diverting pulley and then upwards to the balancing area whereas the other part is directly guided upwards from said component to the balancing area. This has the advantage that the compensation rope can be connected only to that component which is adjacent to the balancing area. Anyway, it necessitates a run of the compensation roper in the elevator shaft to the bottom thereof.

According to a preferred embodiment of the invention a first part of the compensation rope is connected with the car and a second part of the compensation rope is connected with the counterweight. Both, the first and second parts of the compensation rope are led upwards to an upper part of the elevator shaft where they are guided over at least one upper diverting pulley to a balancing area aside of the travelling part of the car and counterweight. In the balancing area both parts are where they are connected by a third balancing part of the compensation rope. Via this arrangement the compensation rope is completely moved away from the shaft part below the car and counterweight path and is only present above these components.

Preferably, the first and second part of the compensation rope is directly let upward from the car or counterweight to the upper diverting pulley (s). In this case the corresponding first and/or second part is/are preferably fixed to the top of the car/counterweight so that in this solution no compensation ropes are present below the car or counterweight.

In another embodiment of the invention the first and/or second part of the compensation rope may also be led downwards from the car/counterweight to a lower diverting pulley before being led upward to the upper diverting pulleys. In this case either only the first or second connecting part to the car or counterweight is located in the elevator shaft below the travel path of the car/counterweight. Via this arrangement only one part of the compensation rope—either the first or second part—is located in the area below the car and counterweight paths. Via this arrangement a mutual contact between compensation rope parts traveling with opposite directions is impossible. Accordingly, also this arrangement improves the safety of the system in total.

Alternatively both parts are firstly guided down to the shaft bottom and run around lower diverting pulleys before running to the upper diverting pulleys and from there to the balancing area. Also in this case the weight balancing third part of the compensation rope is provided in a separate balancing area as to avoid any interference with the car or counterweight.

Preferably, the third balancing part of the compensation rope is formed by a compensation chain with a heavier weight/length than the first and second parts. By this arrangement the balancing part may kept shorter than in an arrangement where the balancing part is made from the same material as the first and second parts of the compensation rope.

Preferably, in the balancing area vertical guide means are provided to separate the vertical parts of the compensation rope as to avoid a contact between compensation rope portions running in opposite directions.

Preferably but not necessarily a tension means may be provided in the balancing area to tighten the sling of the balancing rope in the lower direction. This reduces the compensation rope sway in case of a heavy sway of the ship where the elevator is built.

With respect to the upper diverting pulleys an arrangement is preferable where either the first or second part of the compensation rope is led via one upper diverting pulley into the balancing area whereas the other part is led via two upper diverting pulleys into the balancing area. This arrangement with three upper diverting pulleys is sufficient to ensure that the complete balancing portion of the compensation rope consisting of portions of the first and second compensation rope parts and the complete third balancing part of the compensation rope are vertically suspended in the balancing area. With respect to the traction sheave an additional diverting pulley can be provided to adjust the distance between the vertical parts of the hoisting rope between car and counterweight.

The term "rope" either in connection with hoisting rope or compensation rope may be understood to comprise a single rope or a set of several separate ropes as usually used in elevators for safety reasons.

The above embodiments may be combined arbitrarily with each other as long as the corresponding technical features do not exclude such a combination.

The invention is schematically shown hereinafter with the aid of the enclosed drawings.

Figure 3:
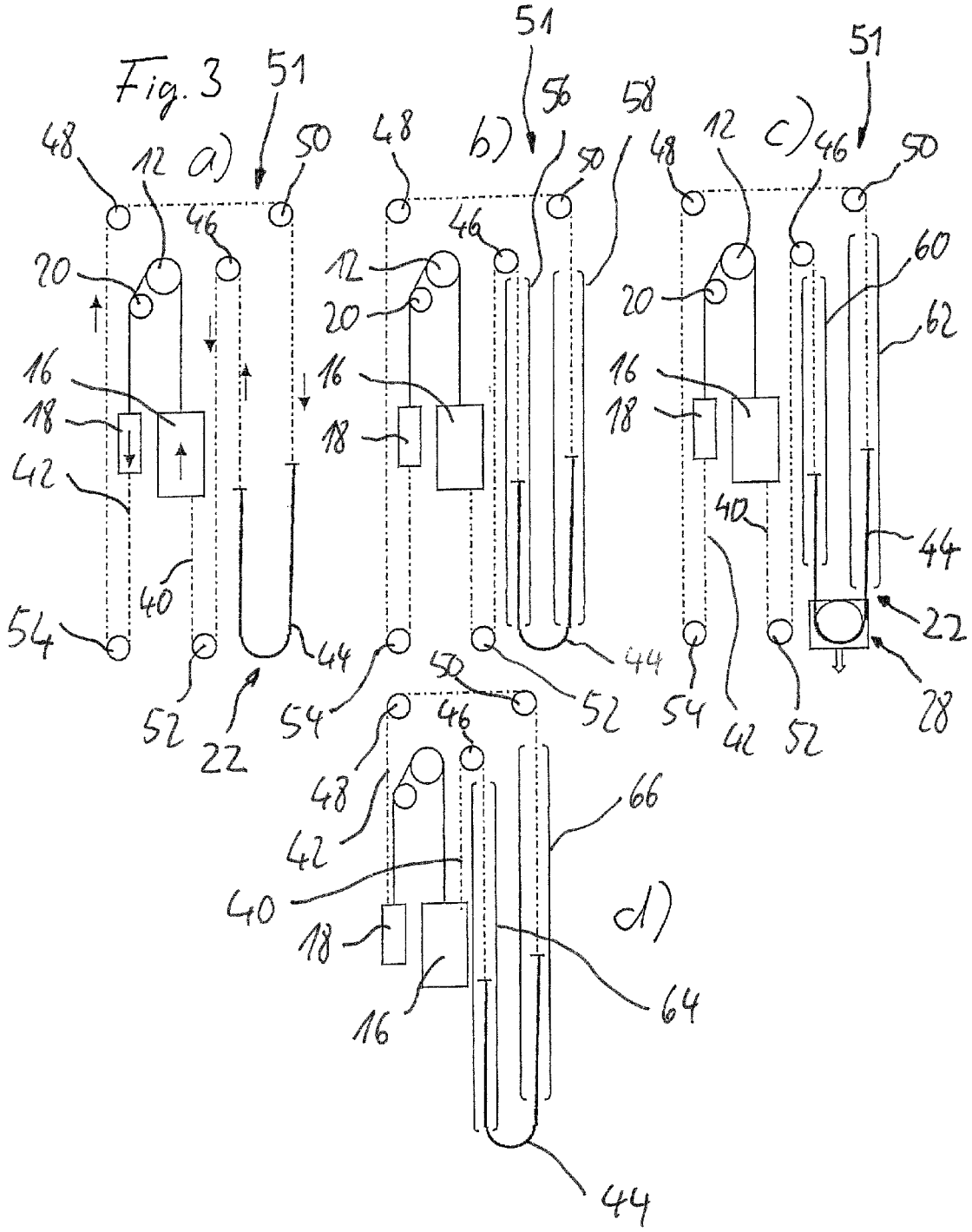
Figure 4:
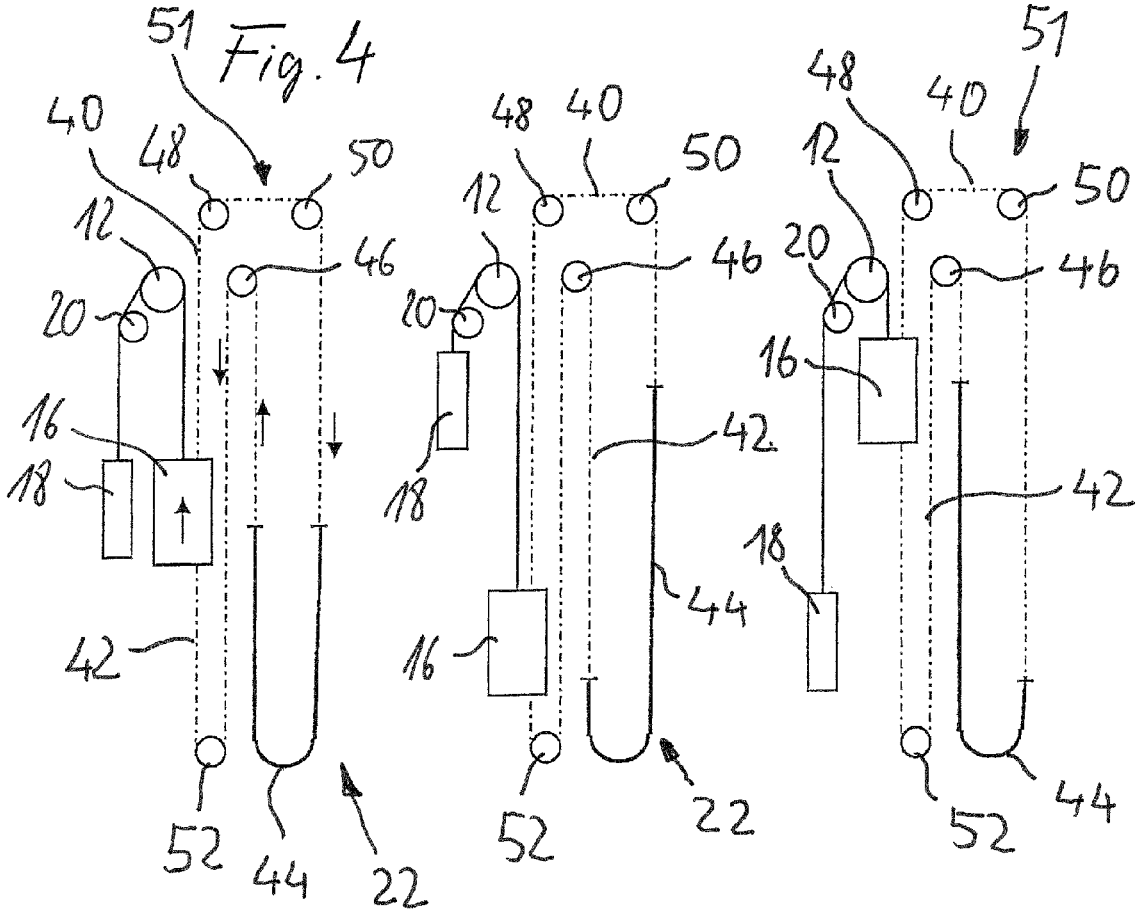

FIG. 1*a-d* show four concepts of elevators with compensating ropes according to the background art, FIG. 2*a-c* show a first embodiment of the invention in three different car positions, FIG. 3*a-d* show four different embodiments of the invention, and FIG. 4 shows a schematically drawing of a further embodiment of the invention in three different positions of the elevator car.

In all drawings identical or functionally similar parts have the same reference numbers.

Figure 2:
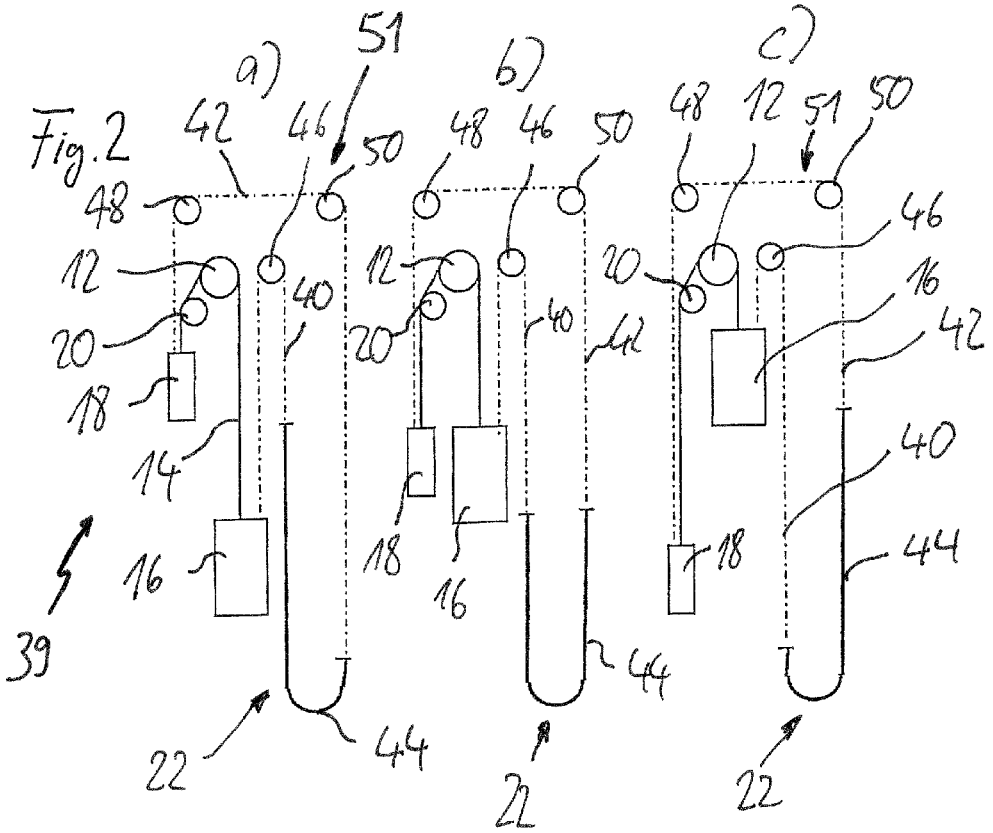

The elevator 39 in FIG. 2 comprises a car 16 and a counterweight 18 suspended on hoisting rope 14. The hoisting rope 14 runs over a traction sheave 12 which drives the hoisting rope as to move the car 16 and counterweight 18 vertically in an elevator shaft (not shown). An upper drive diverting pulley 20 is provided adjacent to the traction sheave to keep the car and counterweight in a desired mutual distance. The car 16 and the counterweight 18 are connected with a compensation rope 22 as follows. The top of the car 16 is connected with a first part 40 of the compensation rope which runs directly upwards from the elevator car to a first upper diverting pulley 46 and from there to a balancing area 51 aside of the travel path of the car 16 and counterweight 18. If the balancing area is located further aside the car and counterweight paths also two pulleys can be used which are then placed in a desired horizontal distance.

A second part 42 of the compensation rope 22 is connected to the top of the counterweight 18 and runs over a second upper diverting pulley 48 and a third upper diverting pulley 50 located in a horizontal distance in the top of the elevator shaft to the balancing area 51. The first and second parts 40, 42 of the compensation rope are connected with a third balancing part 44 of the compensation rope 22 which consists either of the same material as the first and second part 40, 42 or which is made from a different material which is preferable heavier than the first and second parts, e.g. a balancing chain. The FIGS. 2*a* to 2*c* show the arrangement of car, counterweight and compensation rope in the two characteristic extreme positions as well as in the neutral position of the car and counterweight. FIG. 2*a* shows the car at its lower most position, FIG. 2*b* shows the car and counterweight on the same level and FIG. 2*c* shows the car in its upper most position. It can clearly be seen that the compensation rope pulls that component to the top which is on a lower level in the elevator shaft and thus compensates the hoisting rope weight. Accordingly, in FIG. 2*a* the upper most portion of the balancing part 44 of the compensation chain 22 pulls at the elevator car which is in its lower most position and therefore compensates for the part of the hoisting ropes which is to be moved by the traction sheave 12. In FIG. 2*c* it is vice versa whereas in FIG. 2*b* the compensation rope and particularly the third balancing part 44 of the compensation rope is in equilibrium so that the resulting force of the balancing rope 22 on the car and counterweight is zero.

FIG. 3 shows an embodiment very similar to FIG. 2 whereby in this case the first part of the compensation rope runs from the bottom of the car to a first lower diverting pulley 52 located in the bottom of the elevator shaft before it is led to the first upper diverting pulley 46. The second part 42 of the compensation rope 22 is guided from the bottom of the counterweight 18 down to a second lower diverting pulley 54 in the bottom of the elevator shaft before being led up to the second and third upper diverting pulleys 48, 50.

FIG. 3*b* additionally shows vertical guide means 56, 58 provided in the balancing area 51 along nearly the complete vertical portions of the balancing rope. This avoids a mutual contact of the opposite running portions of the compensation rope 22 in the balancing area even if quite large horizontal forces act on these rope parts and/or if the complete elevator system sways heavily, e.g. in a ship during rough sea.

FIG. 3*c* shows a similar arrangement as in FIG. 3*b* but here the guide means 60, 62 for the different parts of the compensation rope have different lengths and tension means 28 is provided in the bottom of the balancing area 51 to keep the compensation rope 22 under tension. This embodiment has an improved safety against horizontal forces and sway. The second guide means 62 provided for the second part 42 of the compensation rope has a larger length according to the larger distance between the third upper pulley 50 and the tensioning means 28 compared to the distance of the first upper pulley 46 to the tensioning means 28.

FIG. 3*d* shows an arrangement similar to FIGS. 3*b* and 3*c* wherein two guide means 64, 66 in the balancing area are provided at different height levels quite immediately below the corresponding upper diverting pulleys 46, 50.

Finally, FIG. 4 shows an arrangement where the compensation rope 22 is only connected to one elevator component, in this case the elevator car. The compensation rope could also be connected to the counterweight only, particulary if the balancing area 51 would be located adjacent to the counterweight path. The bottom of the elevator car 16 is connected to the first part 40 of the compensation rope which is led to a first lower diverting pulley 52 in the elevator shaft bottom and from there up to the first upper diverting pulley 46 into the balancing area 51. The second part 42 of the compensation rope 22 is connected to the top of the elevator car 16 and runs over second and third upper diverting pulleys 48, 50 into the balancing area 51 where both parts 40, 42 are connected to the third balancing part 44 of the compensation rope 22. In this arrangement the compensation rope 22 pulls either on the top or on the bottom of the elevator car according to the position of the elevator car and the elevator shaft. FIG. 3*a* to 3*c* shows the three characteristic positions of the elevator car in the elevator shaft as FIG. 2.

It should be understand by the skilled person that features of the different embodiments of the drawings could be combined with each other as long as this is technically feasible. The invention can be modified within the scope of the appended patent claims.

The invention claimed is:

1. An elevator comprising:

a car and a counterweight which are at least partly suspended on hoisting ropes and a drive machine driving a traction sheave engaging the hoisting ropes for moving the car in an elevator shaft; and a compensation rope, wherein the compensation rope is led upwards to an upper part of the elevator shaft and from there aside to a balancing area located aside of the travel paths of the car and counterweight, wherein a first part of the compensation rope connected with one of the car and counterweight and a second part of the compensation rope connected with the other of the car and counterweight are led upwards to an upper part of the elevator shaft where they are guided over a first upper diverting pulley and a second upper diverting pulley, respectively, wherein the first part of the compensation rope and the second part of the compensation rope are guided via the corresponding first upper diverting pulley and the second upper diverting pulley to the balancing area and in the balancing area downwards to a third balancing part of the compensation rope connecting the first part of the compensation rope and the second part of the compensation rope.

2. The elevator according to claim 1, wherein the balancing area is arranged in a separated part of the elevator shaft or in a separate shaft.

3. The elevator according to claim 2, wherein the first part of the compensation rope is led directly upwards from the one of the car and counterweight to the first diverting pulley.

4. The elevator according to claim 2, wherein the second part of the compensation rope is led directly upwards from the other of the car and counterweight to the second upper diverting pulley.

5. The elevator according to claim 2, wherein the first part of the compensation rope is led downwards from the one of the car and counterweight to a first lower diverting pulley before being led upwards to the first upper diverting pulley.

6. The elevator according to claim 2, wherein the second part of the compensation rope is led downwards from the other of the car or counterweight to a second lower diverting pulley before being led upwards to the second upper diverting pulley.

7. The elevator according to claim 1, wherein the first part of the compensation rope is led directly upwards from the one of the car and counterweight to the first upper diverting pulley.

8. The elevator according to claim 7, wherein the second part of the compensation rope is led directly upwards from the other of the car and counterweight to the second upper diverting pulley.

9. The elevator according to claim 1, wherein the second part of the compensation rope is led directly upwards from the other of the car and counterweight to the second upper diverting pulley.

10. The elevator according to claim 9, wherein the first part of the compensation rope is led downwards from the one of the car and counterweight to a first lower diverting pulley before being led upwards to the first upper diverting pulley.

11. The elevator according to claim 1, wherein the first part of the compensation rope is led downwards from the one of the car and counterweight to a first lower diverting pulley before being led upwards to the first upper diverting pulley.

12. The elevator according to claim 11, wherein the second part of the compensation rope is led downwards from the other of the car and counterweight to a second lower diverting pulley before being led upwards to the second upper diverting pulley.

13. The elevator according to claim 1, wherein the second part of the compensation rope is led downwards from the other of the car or counterweight to a second lower diverting pulley before being led upwards to the second upper diverting pulley.

14. The elevator according to claim 1, wherein the third balancing part of the compensation rope is a compensation chain.

15. The elevator according to claim 1, wherein a vertical guide is provided for the compensation rope in the balancing area.

16. The elevator according to claim 15 wherein the vertical guide extends over at least a major part of a vertical run of the compensation rope in the balancing area.

17. The elevator according to claim 1, wherein, either for the first part of the compensation rope or the second part of the compensation rope, a third upper diverting pulley is provided.

18. The elevator according to claim 1, wherein an auxiliary diverting pulley for the hoisting ropes is provided adjacent to the traction sheave.

19. The elevator according to claim 1, wherein a tensioner for the compensation rope is provided in the balancing area.

* * * * *